US007608770B1

(12) United States Patent
Jacobson

(10) Patent No.: US 7,608,770 B1
(45) Date of Patent: Oct. 27, 2009

(54) VARIABLE RATIO SPRING RETURN FOR BASS DRUM PEDAL

(76) Inventor: Lucas A. Jacobson, 5708 Pennsylvania Ave. N., Crystal, MN (US) 55428

( * ) Notice: Subject to any disclaimer, the term of this patent is extended or adjusted under 35 U.S.C. 154(b) by 52 days.

(21) Appl. No.: 11/511,196

(22) Filed: Aug. 28, 2006

(51) Int. Cl.
*G10D 13/02* (2006.01)

(52) U.S. Cl. ..... 84/422.1; 84/422.2; 84/422.3

(58) Field of Classification Search ..... 84/422.1, 84/104, 403, 404, 411 R, 422.2, 422.3; D17/22, D17/24, 99
See application file for complete search history.

(56) References Cited

U.S. PATENT DOCUMENTS

| | | | | | |
|---|---|---|---|---|---|
| 3,797,356 | A * | 3/1974 | Duffy et al. | ..... | 84/422.1 |
| 4,567,808 | A * | 2/1986 | Smith | ..... | 84/422.1 |
| 4,691,613 | A * | 9/1987 | Jacobson | ..... | 84/422.1 |
| 4,788,897 | A * | 12/1988 | Kirby et al. | ..... | 84/422.1 |
| 4,945,802 | A * | 8/1990 | Ruprecht | ..... | 84/422.1 |
| 5,266,733 | A | 11/1993 | Jacobson | | |
| 5,365,824 | A * | 11/1994 | Hoshino | ..... | 84/422.1 |
| 5,540,131 | A * | 7/1996 | Shigenaga | ..... | 84/422.1 |
| 5,574,237 | A | 11/1996 | Yanagisawa | | |
| 5,714,701 | A * | 2/1998 | Hsieh | ..... | 84/422.1 |
| 5,998,718 | A * | 12/1999 | Liao | ..... | 84/422.1 |
| 6,172,291 | B1 * | 1/2001 | Takegawa | ..... | 84/422.1 |
| 6,271,450 | B1 * | 8/2001 | Mackie | ..... | 84/422.1 |
| 6,590,147 | B2 | 7/2003 | Kassabian | | |

* cited by examiner

*Primary Examiner*—Elvin G Enad
*Assistant Examiner*—Christopher Uhlir

(57) ABSTRACT

A variable ratio spring return for a bass drum pedal includes a bass drum pedal of the type having a driveshaft mounted on a frame for rotation in a positive direction from a rest position to an impact position on a longitudinal axis of the driveshaft. A spring return assembly connected between the frame and the driveshaft biases the driveshaft in a negative direction from the impact position towards the rest position. The spring return assembly includes a spring with ears at opposing ends, one ear connected to the frame and the other ear connected to a cam-shaped hub mounted on the driveshaft. The hub has a peripheral edge that varies in radius from a small radius at an upper end to a large radius at a lower end. A belt has a first end connected to the upper end of the hub and extends downwardly around a forward peripheral edge of the hub to a clip that receives the upper ear of the spring. A second end of the belt is connected to the upper end of the hub and has a second run extending downwardly therefrom along the rearward peripheral edge of the hub to the clip. A pivot arm is connected to the hub and has an outer peripheral edge that forms the lower portion of the hub forward peripheral edge. Pivoting the arm outwardly from the hub changes the radius of curvature of the lower forward peripheral edge of the hub.

19 Claims, 4 Drawing Sheets

VARIABLE RATIO SPRING RETURN FOR BASS DRUM PEDAL

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not Applicable)

INCORPORATION-BY-REFERENCE OF MATERIAL SUBMITTED ON A COMPACT DISC (Not applicable)

BACKGROUND OF THE INVENTION (1) Field of the Invention

The present invention relates generally to bass drum pedals, and more particularly to an improved spring return system for bass drum pedals and other foot-operated musical instruments.

(2) Description of Related Art Including Information Disclosed Under 37 CFR 1.97, 1.98

Although bass drum pedals 11 on the market today use a wide variety of different apparatus for driving a beater or hammer against a drum head, they all rely on three basic components connected to a drive shaft: a beater 12, a foot plate 14, and a spring return 16, as shown in FIG. 1 of the drawings. The beater 12 includes a head or hammer 18 mounted on a distal end of a shaft 20, with the proximal end of the shaft attached to a rotatable drive shaft 22 on a frame 24. Rotation of the drive shaft 22 swings the beater 12 through an arc equal to the angular rotation of the drive shaft 22, towards and away from a drum head 26 to thereby cause an impact of the beater 12 with the drum head 26. The drive shaft 22 is linked to a pivotable footplate 14 with a cable or chain 28 such that depressing the footplate 14 will cause the drive shaft 22 to rotate and swing the beater 12 towards the drum head 26. The spring return 16 is connected between the drive shaft 22 and the frame 24, and biases the drive shaft 22 to return the beater 12 from its impact with the drum head 26 while simultaneously raising the depressed footplate 14 to permit a subsequent stroke.

While there are many different ways that prior art pedals actually connect spring return 16 to driveshaft 22, the most common is by the releasable attachment of a link 30 to drive shaft 22. This may be accomplished by a set screw 32, or any other means that locks the link 30 in the desired position on shaft 22, so that link 30 will rotate with shaft 22. One ear **34*a* of a coil spring 34 is engaged through an aperture 36 in link 30. The opposite ear 34*b* is engaged through an aperture in one end of a threaded rod 38. Threaded rod 38 is journaled through an aperture in a flange 40 on frame 24. A threaded nut 42 is threaded on rod 38 below flange 40, to permit adjustment of the length of rod 38 projecting above flange 40 and thereby adjusting the length of spring 34**.

In general, prior art pedals 11 allow only two spring system adjustments—the altering of the rest point, and the altering of the pre-load length of the spring 34. The rest point is defined as the mechanical position of the bass drum pedal 11 at which the footplate 14 is at rest, i.e. when not being acted upon by a player. This position is also the point at which the spring 34 is under the least amount of tension. FIG. 1 shows a prior art bass drum pedal 11 in the rest position, with the beater shaft 20 resting in a position approximately 60°-80° from drum head 26 with the drive shaft 22 rotated the same degree of rotation in a negative direction. The total operational driveshaft rotation, as measured from 0° at the point of impact of beater hammer 18 with drum head 26 to the point at which spring 34 stops the reverse swing of beater 12, is about 95°-120°.

The rest position of pedal 11 may be adjusted in prior art models by releasing the link 30 from driveshaft 22, which occurs by loosening set screw 32. The desired rest position of beater 12 may then be adjusted by rotating the beater 12 and driveshaft 22. Setscrew 32 is then tightened back onto driveshaft 22 to affix the position of the beater 12.

The second adjustment that is available to the owners of prior art pedals is the adjustment of the pre-load length of spring 34. This is accomplished by the rotation of nut 42 on threaded rod 38. This movement either extends or retracts rod 38 from the upper end of flange 40, thereby effectively increasing or decreasing the spring length.

While both of these adjustments are useful to the drum player, they do not provide the type of additional adjustment that accomplished players desire. For example, a player typically desires to have the beginning of the down-stroke of the pedal with little bias from the return spring, to enable the beater to rapidly increase speed. Then, as the beater approaches the drumhead, the player desires the bias to be geometrically greater, to enable a faster withdrawal of the beater hammer from the drumhead and thereby permit a faster repeat of the stroke. Thus, it is desired to vary the increase in tension of the spring between the rest position and the impact position. This is not possible with prior art pedals.

As shown in FIG. 2, if it is assumed that the footplate is depressed at a constant speed throughout a stroke, the prior art pedal will have a ratio of driveshaft rotation to spring tension that has a constant, straight slope $S_1$ to the point of impact. The beater is then returned with a negative backlash by virtue of the bias of spring 34 applied to the beater. Because there is no rearward or "negative" force applied to the beater other than the spring force, the momentum of the beater will cause the beater to travel past the rest position, but only a short distance—typically about one-half the amount of forward rotation during the impact stroke. If the player does not depress the footplate again for another stroke of the pedal, the spring 34 will eventually return the pedal to the rest position.

Because a spring provides a constant biasing force throughout the distance that it is stretched, the adjustment of the overall length of the spring does not change the slope of the line—which represents the ratio of driveshaft rotation to spring bias. Rather, the change will increase both the preload force and the total force required at the impact position, by the same amount. Thus, while the amount of force required at the impact position is greater, as desired, the amount of resistance encountered at the beginning of the stroke is also increased—which is contrary to what is desired.

Similarly, changing the rest position of the beater will not change the slope of the line. Rather, it simply increases or decreases the distance through which the beater must travel to impact the drumhead.

BRIEF SUMMARY OF THE INVENTION

It is therefore a general object of the present invention to provide an improved spring return system for a bass drum pedal.

A further object is to provide an improved spring return system for a bass drum pedal that will allow the player to adjust the ratio of spring bias to the rotation of driveshaft.

Yet another object of the present invention is to provide an improved spring return system that is simple to adjust and easy to use.

These and other objects will be apparent to those skilled in the art.

The variable ratio spring return for a bass drum pedal of the present invention includes a bass drum pedal of the type having a driveshaft mounted on a frame for rotation in a positive direction from a rest position to an impact position on a longitudinal axis of the driveshaft. A spring return assembly is connected between the frame and the driveshaft to bias the driveshaft in a negative direction from the impact position towards the rest position. The spring return assembly includes a spring with ears at opposing ends, one ear connected to the frame and the other ear connected to a cam-shaped hub mounted on the driveshaft. The hub has a peripheral edge that varies in radius from a small radius at an upper end to a large radius at a lower end. A belt has a first end connected to the upper end of the hub and extends downwardly around a forward peripheral edge of the hub to a clip that receives the upper ear of the spring. A second end of the belt is connected to the upper end of the hub and has a second run extending downwardly therefrom along the rearward peripheral edge of the hub to the clip. A pivot arm is connected to the hub and has an outer peripheral edge that forms the lower portion of the hub forward peripheral edge. Pivoting the arm outwardly from the hub may change the radius of curvature of the lower forward peripheral edge of the hub.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
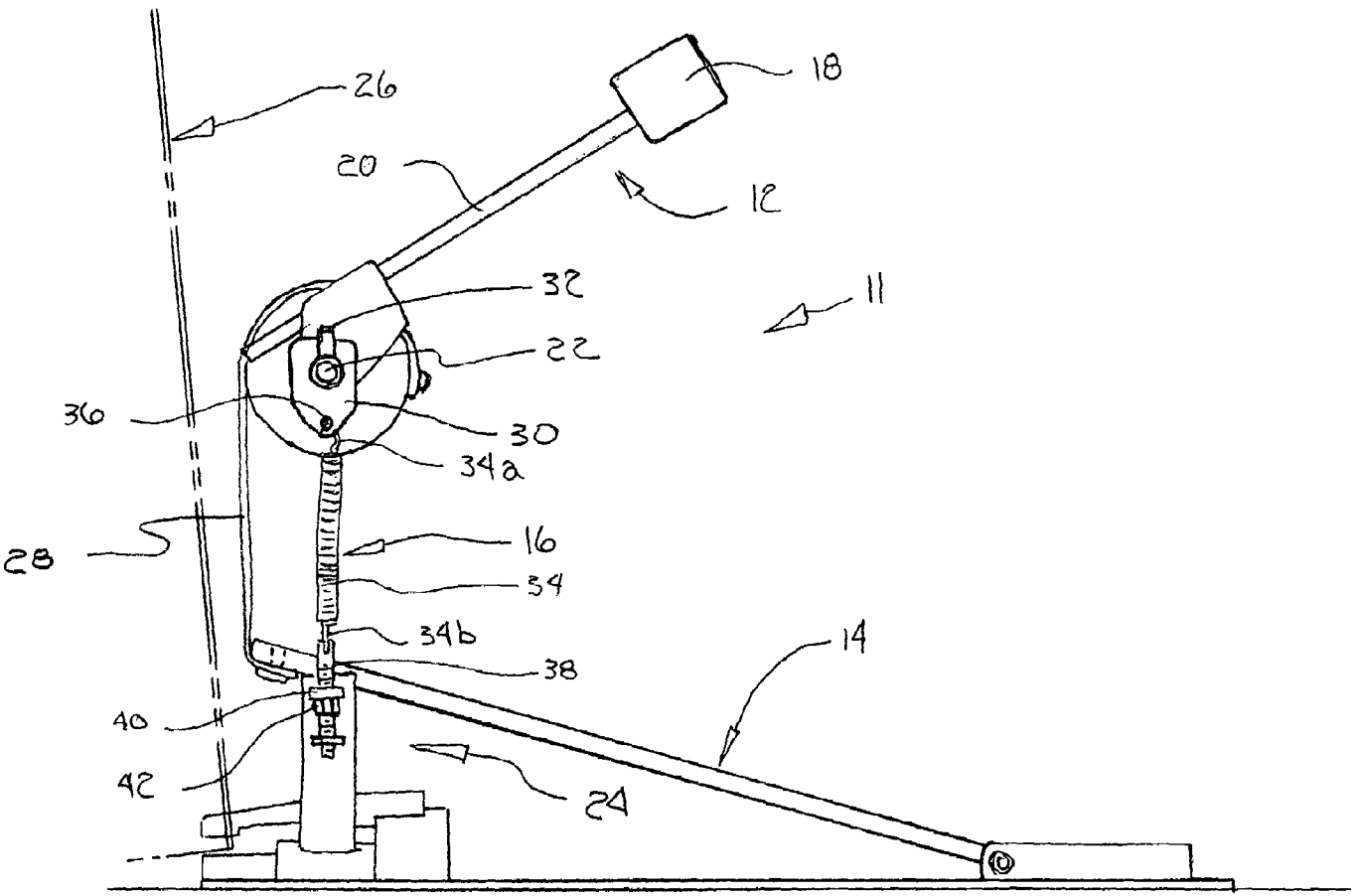
FIG. 1 (PRIOR ART)
FIG. 1 is a side elevational view of a prior art bass drum pedal and spring return system.
Figure 2:
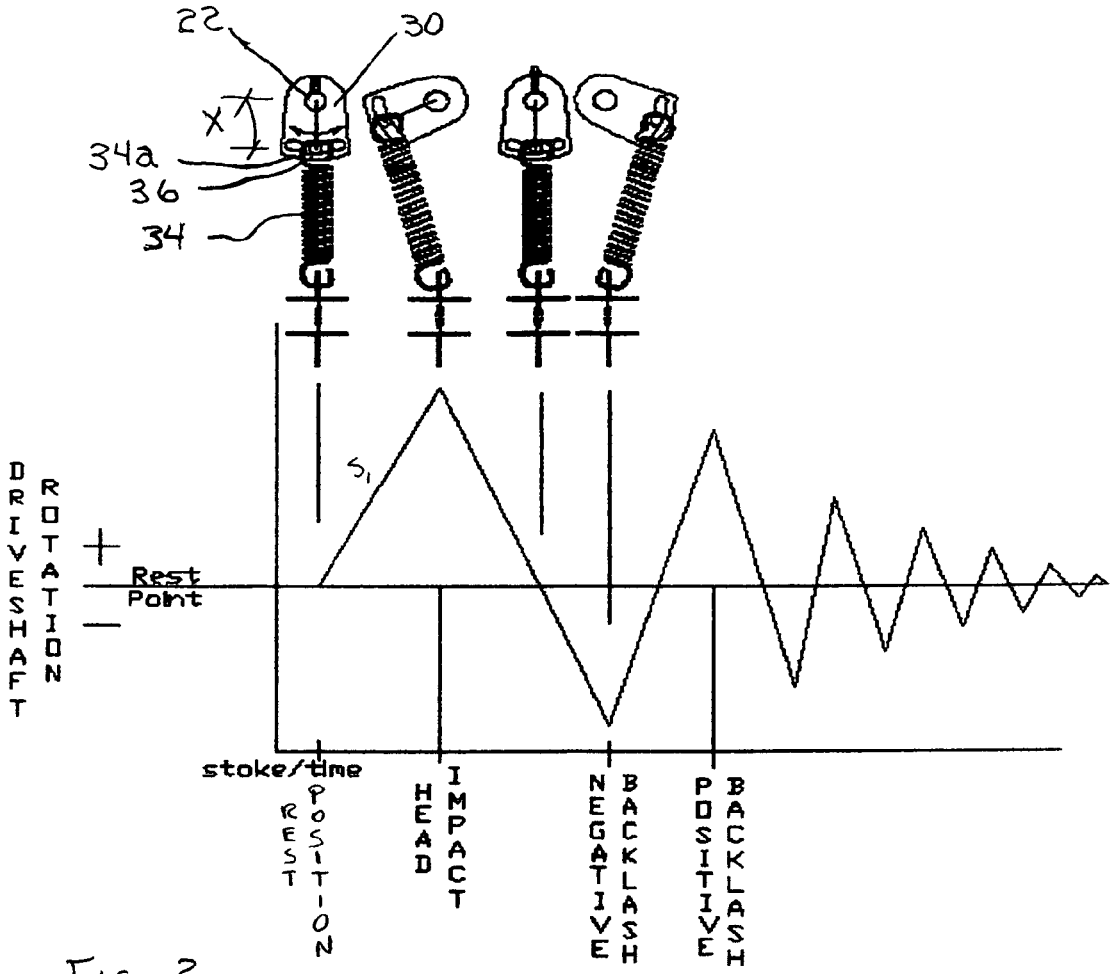
FIG. 2 is a schematic chart showing the relationship between driveshaft rotation and spring tension of the prior art spring return of FIG. 1.

Referring now to the drawings, and more particularly to FIG. 1, a prior art bass drum pedal 11 is shown, with a conventional spring return 16. As discussed above, the location of the upper spring ear 34*a*, engaged in aperture 36 on link 30, fixes the radial distance of the spring ear 34*a* from drive shaft 22. This distance "X", as shown in FIG. 2, essentially forms a pivot arm of fixed length, with the distal end pivoting along a circular path at a radius X from the rotational axis of drive shaft 22.

Figure 3:
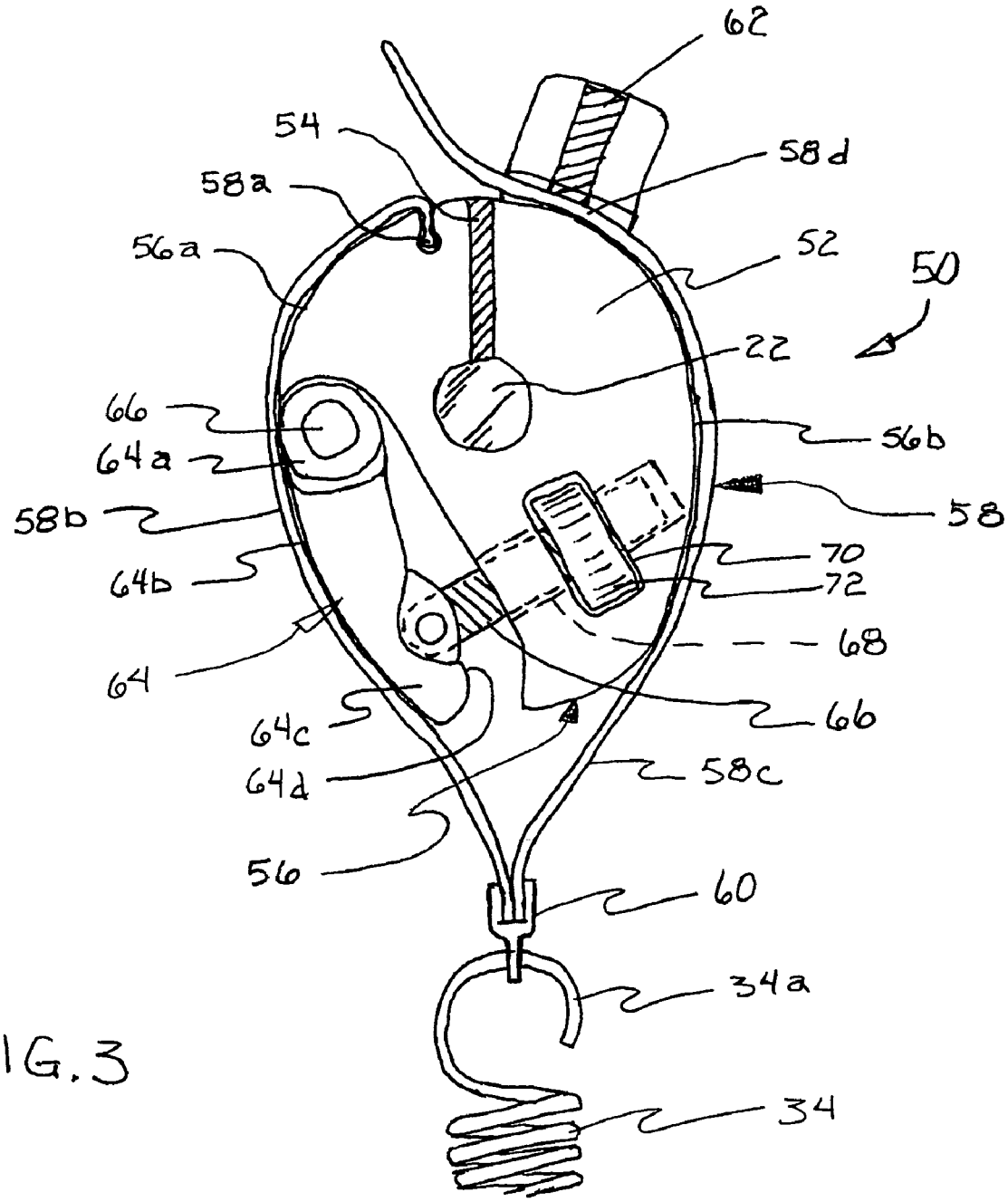
FIG. 3 is an enlarged side elevational view of a variable adjustable pivot arm for the improved spring return of the present invention.

Referring now to FIG. 3, the link 30 (shown in FIGS. 1 and 2) of prior art pedals 11 is replaced with a new and improved variable adjustable spring return, designated generally at 50, which is connected between the upper ear 34*a* of spring 34 and driveshaft 22. Spring return 50 includes a cam hub 52 mounted on driveshaft 22, with a setscrew 54 permitting selective adjustment of the rotational position of hub 52 on driveshaft 22. Setscrew 54 thereby allows selective adjustment of the rest position of the pedal in a fashion similar to that of the prior art.

Hub 52 has a peripheral edge 56 that may be viewed as forward and rearward halves 56*a* and 56*b*, respectively, for clarity of description. A belt 58 has a first end 58*a* fastened to the peripheral edge 56 of hub 52 near the top of hub 52. A forward "run" 58*b* of belt 58 extends downwardly from first end 58*a*, around the forward peripheral half 56*a* of hub peripheral edge 56, and thence downwardly away from hub 52 to a clip 60. Ear 34*a* of spring 34 is attached to belt 58 at clip 60. A rearward "run" 58*c* of belt 58 extends upwardly from clip 60, around the rearward peripheral half 56*b* of hub peripheral edge 56, to a fixation point 58*d* near the upper end of hub 52. Fixation point 58*d* is preferably releasable, as with a set screw 62, clamp, or the like, to permit the length of the rearward belt run 58*c* to be selectively adjusted.

The rearward peripheral half 56*b* of hub 52, and the associated rearward belt run 58*c*, controls the bias of spring 34 in the "negative backlash" portion of the stroke, as the beater swings past the rest position on the return portion of the swing. The forward peripheral half 56*a* of hub 52 will control the ratio of driveshaft rotation to spring pressure between the rest position and the impact position of beater 12. Because hub 52 is cam-shaped, the upper half of each of the forward and rearward peripheral halves 56*a* and 56*b* will have radii that are less than that of the lower halves of the respective forward and rearward peripheral halves 56*a* and 56*b*. In this way, it can be seen that the ratio of driveshaft rotation to spring pressure will not be a constant slope, as it was with prior art spring returns. Rather, the ratio line will be generally parabolic in shape, the slope changing along the length of the line depending upon the actual radius of the peripheral edge 56 at each position of the stroke.

The inventor herein has provided additional flexibility by creating an adjustable curvature in forward peripheral edge 56*a*. An arm 64 is pivotally mounted at an upper end 64*a* on a pivot axis 66 parallel to the axis of driveshaft 22, to pivot from a retracted position with an outer edge 64*b* of the arm 64 generally following a curvature that is a mirror image of the lower half of the rearward peripheral half 56*b* of hub 52, to an extended position with the lower end 64*c* pivoted outwardly. A rod 66 is pivotally connected at a first end to the inward edge 64*d*, with the opposite end extending freely into a well 68 formed in the adjacent edge of hub 52. Well 68 is of sufficient depth to receive rod 66 when in the fully retracted position.

Rod 66 may be selectively extended and retracted from well 68 in a number of different ways. FIG. 3 shows the preferred embodiment with an aperture 70 formed through the body of hub 52 and intersecting well 68. In this embodiment, rod 66 is threaded, and an interiorly-threaded wheel 72 is engaged on the threads of rod 66 and positioned within aperture 70. Because wheel 72 is prevented from moving by the sides of aperture 70, rotation of wheel 72 in either direction will cause rod 66 to extend or retract from well 68.

As noted above, the drawings merely depict the preferred embodiment of the invention, are not intended to disclose the only manner for accomplishing the adjustment of the outside curvature of the cam-shaped hub 52. For example, rod 66 may be selectively secured in the desired position extended or retracted in well 68 by a setscrew or the like. Rather than using a single pivoting arm 64, a series of detachable arms of different shapes could be substituted to accomplish the same objective. It should be understood that other equivalent structure could be used in place of that shown in the preferred embodiment without departing from the scope of the invention.

Figure 4:
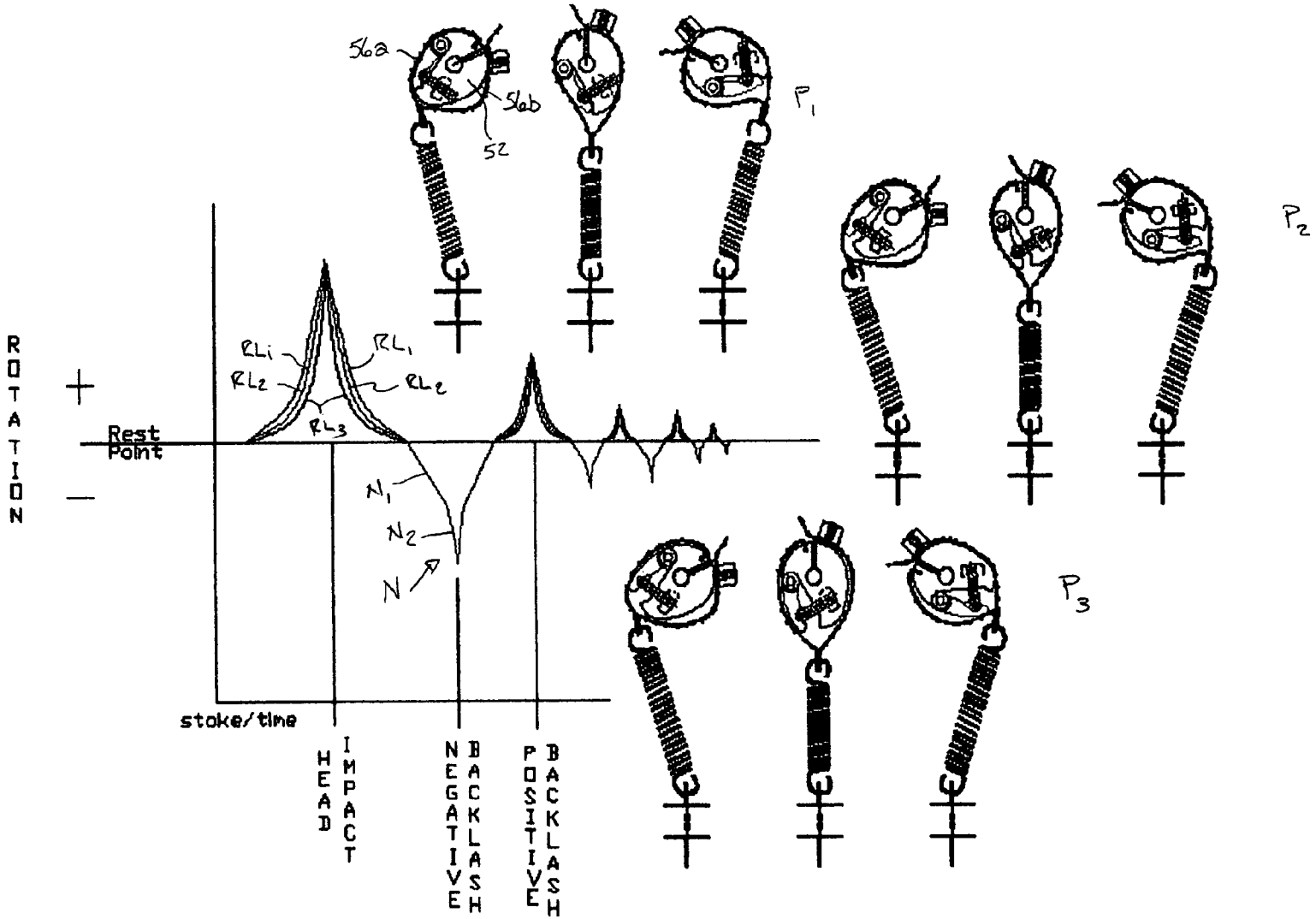
FIG. 4 is a schematic chart showing the relationship between driveshaft rotation and spring tension of three positions of the variable adjustable spring return of FIG. 3.

Referring now to FIG. 4, a schematic diagram is provided graphically showing at least three major improvements of the variable adjustable spring return of the present invention prior art spring returns. FIG. 4 shows hub 52 spring return 50 in three different configurations, namely configuration $P_1$, $P_2$, and $P_3$. Configuration $P_1$ shows hub 52 with pivot arm 64 in a fully retracted position. Configuration $P_2$ shows hub 52 with pivot arm 64 in a partially extended position. Configuration $P_3$ shows hub 52 with pivot arm 64 in a fully extended position. Each configuration $P_1$, $P_2$, and $P_3$, shows three different positions driveshaft of the bass drum pedal, namely, the impact position, the rest position, and the "backlash" position, respectively. The positive portion of the graphic chart maps the portion of the three ratio lines representing the ratio of driveshaft rotation to spring tension. A single line is used in the negative portion of the chart, since the return portion of the movement is identical with all three configurations.

Referring now to both FIGS. 2 and 4, the first major improvement over prior art spring returns may be readily seen in referring to ratio line $R_1$ in FIG. 4, and comparing it to ratio line $S_1$ in FIG. 2. Ratio line $R_1$ represents the ratio of driveshaft rotation to spring tension for configuration $P_1$ of hub 52 as the bass drum pedal is operated through a stroke. The important feature that should be noted is the fact that ratio line $R_1$ is not straight, as is line $S_1$, but rather has a variable slope with a generally parabolic shape. The slope of the line is fairly shallow at the beginning of a stroke, and rapidly increases near the impact position. This same parabolic shape is found as the pedal returns toward the rest position after impact. The cam shape of the forward half 56*a* of peripheral edge 56 of hub 52 creates this unique variable slope ratio line. This curved ratio line provides the player with a significantly improved action in the pedal, since it concentrates the spring tension at the portion of the stroke nearest the impact position, permitting the player to repeat the impact much more rapidly than possible with prior art spring returns.

The second major improvement over prior art spring returns is depicted in the three different ratio lines $R_1$, $R_2$, and $R_3$ on the positive portion of the chart. As shown in FIG. 2, only a single position and ratio line $S_1$ is possible with prior art pedals. With the spring return 50 of the present invention, the parabolic ratio line may be adjusted and "fine tuned" by adjusting the pivot arm 64 on hub 52. While three different configurations are shown in FIG. 4, it should be noted that virtually universal adjustment between configurations $P_1$ and $P_3$ are possible.

The third major improvement over prior art spring returns is depicted in the negative portion of the graph, where the ratio lines of the three different configurations $P_1$, $P_2$ and $P_3$ during the negative driveshaft rotation past the rest position are represented by ratio line N. More particularly, it should be noted that the negative ratio line N has a variable slope. In this embodiment of the invention, two distinct slopes, $N_1$ and $N_2$, are created by virtue of the cam shape on the rearward half 56*b* of hub peripheral edge 56 in conjunction with the rearward run 58*c* of belt 58. Because belt 58 has a length greater than the overall length of the peripheral edge 56*b* of hub 56, the belt hangs loose for the first portion of the negative rotation of the driveshaft past the rest position (line $N_1$), with the radius of the hub generally small. As hub 52 continues to rotate in a negative direction, belt 58 contacts the rearward half 56*b* of the peripheral edge 56 of hub 52, and is rapidly drawn rearwardly by the large radius of the cam shape at the lower end of hub 52 (line $N_2$). This variable slope will more rapidly slow the negative backlash of the beater, and return it towards the rest position more quickly.

Whereas the invention has been shown and described in connection with the preferred embodiments thereof, many modifications, substitutions and additions may be made which are within the intended broad scope of the appended claims.

What is claimed is:

1. A variable adjustable spring return for a bass drum pedal, the pedal of the type having a driveshaft mounted on a frame for rotation in a positive direction from a rest position to an impact position on a longitudinal axis of the driveshaft, and a spring return assembly connected between the frame and the driveshaft to bias the driveshaft in a negative direction from the impact position towards the rest position, said spring return assembly including a spring with first and second ears at opposing ends, the first ear connected to the frame and the second ear connected to the driveshaft, the spring return comprising:

a cam-shaped hub mounted on said driveshaft for rotation therewith, said hub having a peripheral edge that varies in radius, an upper peripheral portion of the hub having a radius less than a lower peripheral portion of the hub;

said hub peripheral edge including a forward peripheral half and a rearward peripheral half;

an elongated flexible belt having a first end connected to the upper peripheral portion of the hub forward peripheral half and a first run extending downwardly therefrom along the forward peripheral half of the hub;

said belt having a second end connected to the upper peripheral portion of the hub rearward peripheral half and a second run extending downwardly therefrom along the rearward peripheral half of the hub;

said belt first and second runs connected together and to a spring retention clip located below the lower peripheral portion of the hub;

said spring second ear connected to the clip for movement with the clip on the belt.

2. The spring return of claim 1, wherein said hub is adjustably mounted on the driveshaft, for selective adjustment about the longitudinal axis of the driveshaft.

3. The spring return of claim 2, wherein said belt second end is selectively adjustably connected to the hub, for selective lengthening and shortening of the second run of the belt.

4. The spring return of claim 3, further comprising means for selectively changing the radius of curvature of a portion of the hub forward peripheral half, to thereby selectively change the ratio of driveshaft rotation to spring tension as the driveshaft rotates between the rest position and impact position on its longitudinal axis.

5. The spring return of claim 4, wherein said means for selectively changing the radius of curvature of a portion of the hub forward peripheral half includes:

a pivot arm connected at an upper end to the hub for pivotal movement on an axis parallel to the driveshaft longitudinal axis;

said pivot arm including an outer peripheral edge forming a lower portion of the hub forward peripheral edge; and means connected between the arm and the hub for selectively pivoting the arm between a retracted position with the lower end of the arm proximal the hub, and an extended position with the lower end of the arm spaced from the hub.

6. The spring return of claim 5, wherein the means for selectively pivoting the arm includes:

a rod pivotally connected at a first end to an inward edge of the arm;

a well formed in the hub proximal and aligned with the rod;

said rod extending from the first end to a second end slidably disposed within the well, and positioned to extend and retract from the well to thereby pivot the arm to the extended and retracted positions, respectively; and means for selectively retaining the second end of the rod in a selected position in the well.

7. The spring return of claim 1, wherein said belt second end is selectively adjustably connected to the hub, for selective lengthening and shortening of the second run of the belt.

8. The spring return of claim 1, further comprising means for selectively changing the radius of curvature of a portion of the hub forward peripheral half, to thereby selectively change the ratio of driveshaft rotation to spring tension as the driveshaft rotates between the rest position and impact position on its longitudinal axis.

9. The spring return of claim 8, wherein said means for selectively changing the radius of curvature of a portion of the hub forward peripheral half includes:

a pivot arm connected at an upper end to the hub for pivotal movement on an axis parallel to the driveshaft longitudinal axis;

said pivot arm including an outer peripheral edge forming a lower portion of the hub forward peripheral edge; and means connected between the arm and the hub for selectively pivoting the arm between a retracted position with the lower end of the arm proximal the hub, and an extended position with the lower end of the arm spaced from the hub.

10. The spring return of claim 9, wherein the means for selectively pivoting the arm includes:

a rod pivotally connected at a first end to an inward edge of the arm;

a well formed in the hub proximal and aligned with the rod;

said rod extending from the first end to a second end slidably disposed within the well, and positioned to extend and retract from the well to thereby pivot the arm to the extended and retracted positions, respectively; and means for selectively retaining the second end of the rod in a selected position in the well.

11. A variable ratio spring return for a bass drum pedal spring return assembly, comprising:

a cam-shaped hub having means for mounting the hub to a driveshaft on a bass drum pedal, said hub having a rotational axis, said hub having a peripheral edge that varies in radius, an upper peripheral portion of the hub having a radius less than a lower peripheral portion of the hub;

said hub peripheral edge including a forward peripheral half and a rearward peripheral half;

an elongated flexible belt having a first end connected to the upper peripheral portion of the hub forward peripheral half and a first run extending downwardly therefrom along the forward peripheral half of the hub;

said belt having a second end connected to the upper peripheral portion of the hub rearward peripheral half and a second run extending downwardly therefrom along the rearward peripheral half of the hub;

said belt first and second runs connected together and to a spring retention clip located below the lower peripheral portion of the hub;

said clip including means for retaining one end of a spring of the spring return assembly.

12. The spring return of claim 11, wherein said belt second end is selectively adjustably connected to the hub, for selective lengthening and shortening of the second run of the belt.

13. The spring return of claim 11, further comprising means for selectively changing the radius of curvature of a portion of the hub forward peripheral half, to thereby selectively change the ratio of driveshaft rotation to spring tension as the hub rotates on a driveshaft of a bass drum pedal.

14. The spring return of claim 13, wherein said means for selectively changing the radius of curvature of a portion of the hub forward peripheral half includes:

a pivot arm connected at an upper end to the hub for pivotal movement on an axis parallel to a pivot axis of the hub;

said pivot arm including an outer peripheral edge forming a lower portion of the hub forward peripheral edge; and means connected between the arm and the hub for selectively pivoting the arm between a retracted position with the lower end of the arm proximal the hub, and an extended position with the lower end of the arm spaced from the hub.

15. The spring return of claim 14, wherein the means for selectively pivoting the arm includes:

a rod pivotally connected at a first end to an inward edge of the arm;

a well formed in the hub proximal and aligned with the rod;

said rod extending from the first end to a second end slidably disposed within the well, and positioned to extend and retract from the well to thereby pivot the arm to the extended and retracted positions, respectively; and means for selectively retaining the second end of the rod in a selected position in the well.

16. A bass drum pedal, comprising:

a frame;

a footplate pivotally connected proximal a heel end to the frame;

a generally horizontally disposed rotatable drive shaft supported on the frame above a forward end of the footplate;

a beater, including a hammer carried at the end of a beater shaft connected to the driveshaft;

a drive assembly connecting the footplate and drive shaft, for rotating the driveshaft to move the hammer in contact with a drum when the footplate is pivoted; and a spring return assembly connected between the frame and the driveshaft, for resisting rotational movement of the driveshaft, said spring return assembly including:

a spring with first and second ears at opposing ends, the first ear connected to the frame and the second ear connected to the driveshaft;

a cam-shaped hub mounted on said driveshaft for rotation therewith, said hub having a peripheral edge that varies in radius, an upper peripheral portion of the hub having a radius less than a lower peripheral portion of the hub;

said hub peripheral edge including a forward peripheral half and a rearward peripheral half;

an elongated flexible belt having a first end connected to the upper peripheral portion of the hub forward peripheral half and a first run extending downwardly therefrom along the forward peripheral half of the hub;

said belt having a second end connected to the upper peripheral portion of the hub rearward peripheral half and a second run extending downwardly therefrom along the rearward peripheral half of the hub;

said belt first and second runs connected together and to a spring retention clip located below the lower peripheral portion of the hub;

said spring second ear connected to the clip for movement with the clip on the belt.

17. The bass drum pedal of claim 16, further comprising means for selectively changing the radius of curvature of a portion of the hub forward peripheral half to thereby selectively change the ratio of driveshaft rotation to spring tension as the driveshaft rotates between the rest position and impact position on its longitudinal axis.

18. The bass drum pedal of claim 17, wherein said means for selectively changing the radius of curvature of a portion of the hub forward peripheral half includes:

a pivot arm connected at an upper end to the hub for pivotal movement on an axis parallel to the driveshaft longitudinal axis;

said pivot arm including an outer peripheral edge forming a lower portion of the hub forward peripheral edge; and means connected between the arm and the hub for selectively pivoting the arm between a retracted position with the lower end of the arm proximal the hub, and an extended position with the lower end of the arm spaced from the hub.

19. The bass drum pedal of claim 18, wherein the means for selectively pivoting the arm includes:

a rod pivotally connected at a first end to an inward edge of the arm;

a well formed in the hub proximal and aligned with the rod;

said rod extending from the first end to a second end slidably disposed within the well, and positioned to extend and retract from the well to thereby pivot the arm to the extended and retracted positions, respectively; and means for selectively retaining the second end of the rod in a selected position in the well.

* * * * *